US006055906A

United States Patent [19]

Lewis

[11] Patent Number: 6,055,906

[45] Date of Patent: May 2, 2000

[54] METHOD OF LITHOGRAPHIC IMAGING WITHOUT DEFECTS OF ELECTROSTATIC ORIGIN

[75] Inventor: Thomas E. Lewis, East Hampstead, N.H.

[73] Assignee: Presstek, Inc., Hudson, N.H.

[21] Appl. No.: 09/185,812

[22] Filed: Nov. 4, 1998

[51] Int. Cl.[7] ..... B41N 1/14; B41N 6/00

[52] U.S. Cl. ..... 101/467; 101/415.1; 101/462

[58] Field of Search ..... 101/453, 454, 101/456, 457, 460, 462, 463.1, 465–467, 415.1; 430/302, 303

[56] References Cited

U.S. PATENT DOCUMENTS

| | | | |
|---|---|---|---|
| Re. 35,512 | 5/1997 | Nowak et al. | 101/454 |
| 4,132,826 | 1/1979 | Dessauer et al. | 101/465 |
| 4,599,943 | 7/1986 | Kobler | 101/415.1 |
| 5,052,292 | 10/1991 | Lewis et al. | 101/142 |
| 5,165,345 | 11/1992 | Lewis et al. | 101/453 |
| 5,339,737 | 8/1994 | Lewis et al. | 101/454 |
| 5,570,636 | 11/1996 | Lewis | 101/454 |
| 5,582,106 | 12/1996 | Kanda et al. | 101/462 |
| 5,632,204 | 5/1997 | Lewis | 101/453 |
| 5,709,971 | 1/1998 | Bowman et al. | 101/464 |
| 5,950,541 | 9/1999 | Nakayama et al. | 101/463.1 |

FOREIGN PATENT DOCUMENTS

| | | |
|---|---|---|
| 0580393A2 | 1/1994 | European Pat. Off. . |
| 0755781A1 | 1/1997 | European Pat. Off. . |

*Primary Examiner*—Stephen R. Funk
*Attorney, Agent, or Firm*—Cesari and McKenna, LLP

[57] ABSTRACT

Defects of electrostatic origin in lithographic printing plates are prevented by reducing or minimizing the dielectric nature of the various plate layers. This lessens the capacitance of the system, reducing the voltage that results from a given deposited charge and, consequently, the likelihood of arcing. This may be accomplished by utilizing, for the substrate of the plate, a conductive film.

8 Claims, 1 Drawing Sheet

105a
114
100
112
110
1B
1B
105b 114
135
112
135
114
100
120
125
130
140

150

METHOD OF LITHOGRAPHIC IMAGING WITHOUT DEFECTS OF ELECTROSTATIC ORIGIN

BACKGROUND OF THE INVENTION

1. Field of the Invention

The present invention relates to digital printing apparatus and methods, and more particularly to imaging of lithographic printing-plate constructions on- or off-press using digitally controlled laser output.

2. Description of the Related Art

In offset lithography, an image to be transferred to a recording medium is represented on a plate, mat or other printing member as a pattern of ink-accepting (oleophilic) and ink-repellent (oleophobic) surface areas. In a dry printing system, the member is simply inked and the image transferred onto a recording material; the member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic in the sense of affinity for dampening (or "fountain") solution, and the necessary ink-repellency is provided by an initial application of such a solution to the plate prior to or during inking. The ink-abhesive fountain solution prevents ink from adhering to the non-image areas, but does not affect the oleophilic character of the image areas.

A lithographic image is applied to a blank plate by altering its affinity characteristics in an imagewise pattern—that is, a pattern corresponding to the material to be printed. This may be accomplished photographically, by imagewise exposure of the blank plate to appropriate radiation followed by chemical development, or physically, using (for example) digitally controlled lasers to remove or facilitate mechanical removal of one or more plate layers in the imagewise pattern.

In a laser-based direct-write process, the laser imagewise removes (or facilitates removal of) ink-rejecting, non-image portions of the printing blank to reveal an ink-accepting layer that carries the image. In an indirect-write system, the laser instead removes ink-accepting portions of the blank. The choice of imaging mode depends less on the characteristics of the imaging system (since in digitally operated systems the mode can be changed merely by inverting the output bitmap) than on the structure of the printing member employed.

Lithographic printing members are now commonly imaged by low-power ablation imaging mechanisms. U.S. Pat. Nos. 5,339,737, 5,632,204, 5,783,364, and Reissue U.S. Pat. No. 35,512 (the entire disclosures of which are hereby incorporated by reference), for example, disclose a variety of ablation-type lithographic plate configurations for use with imaging apparatus that utilize diode lasers. For example, laser-imageable lithographic printing constructions in accordance with these patents may include a first, topmost layer chosen for its affinity for (or repulsion of) ink or a fluid to which ink will not adhere; an ablation layer, which volatilizes into gaseous and particulate debris in response to imaging (e.g., infrared, or "IR") radiation, thereunder; and beneath the imaging layer, a strong, durable substrate characterized by an affinity for (or repulsion of) ink or a fluid to which ink will not adhere opposite to that of the first layer. Ablation of the imaging layer weakens the topmost layer as well. By disrupting its anchorage to an underlying layer, the topmost layer is rendered easily removable in a post-imaging cleaning step, creating an image spot having a lithographic affinity differing from that of the unexposed first layer.

During the imaging process or, subsequently, during use of the plate on a press, defects of electrostatic origin can be generated. These tend to occur around "floating" plate regions—that is, where an unimaged area is isolated from more extensive unimaged areas by a thin imaged boundary. A plate might, for example, consist of a layer of ink-rejecting silicone over a thin titanium imaging layer, which itself overlies an ink-receptive polyester substrate. The edges of the plate are generally pinned to a plate cylinder by metal clamps, which, due to their mechanical association with the press, are electrically grounded. Consequently, electrostatic charge accumulating on regions of the silicone held by the clamps dissipates or never develops. Islands of silicone within the plate, however, are electrically isolated from the clamps. As a result, the accumulated charge is trapped. The silicone and the polyester substrate are dielectric materials, so the potential difference between the charged silicone surface and the underlying metal plate cylinder (which, like the plate clamps, is at ground potential) can become considerable. If sufficient, the charge can arc across the imaged boundary to an unimaged region of silicone in contact with the plate clamps. The arc destroys a small portion of silicone, resulting in a print defect—that is, a spot that accepts ink although it was not imaged by the laser. These defects manifest themselves visibly on copy printed with the plate.

DESCRIPTION OF THE INVENTION

Brief Summary of the Invention

The present invention eliminates or reduces the possibility of encountering defects of electrostatic origin by reducing or minimizing the dielectric nature of the various plate layers. This lessens the capacitance of the system, reducing the voltage that results from a given deposited charge and, consequently, the likelihood of arcing. This may be accomplished by utilizing, for the substrate of the plate, a conductive film. Moreover, if the charged topmost plate layer is itself weakly conductive, the charge will bleed off to ground.

It should be stressed that, as used herein, the term "plate" or "member" refers to any type of printing member or surface capable of recording an image defined by regions exhibiting differential affinities for ink and/or dampening fluid; suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is herein used in the printing sense to connote a surface affinity for a fluid which prevents ink from adhering thereto. Such fluids include water, aqueous and non-aqueous dampening liquids, the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figures 1A, 1B, 1C:
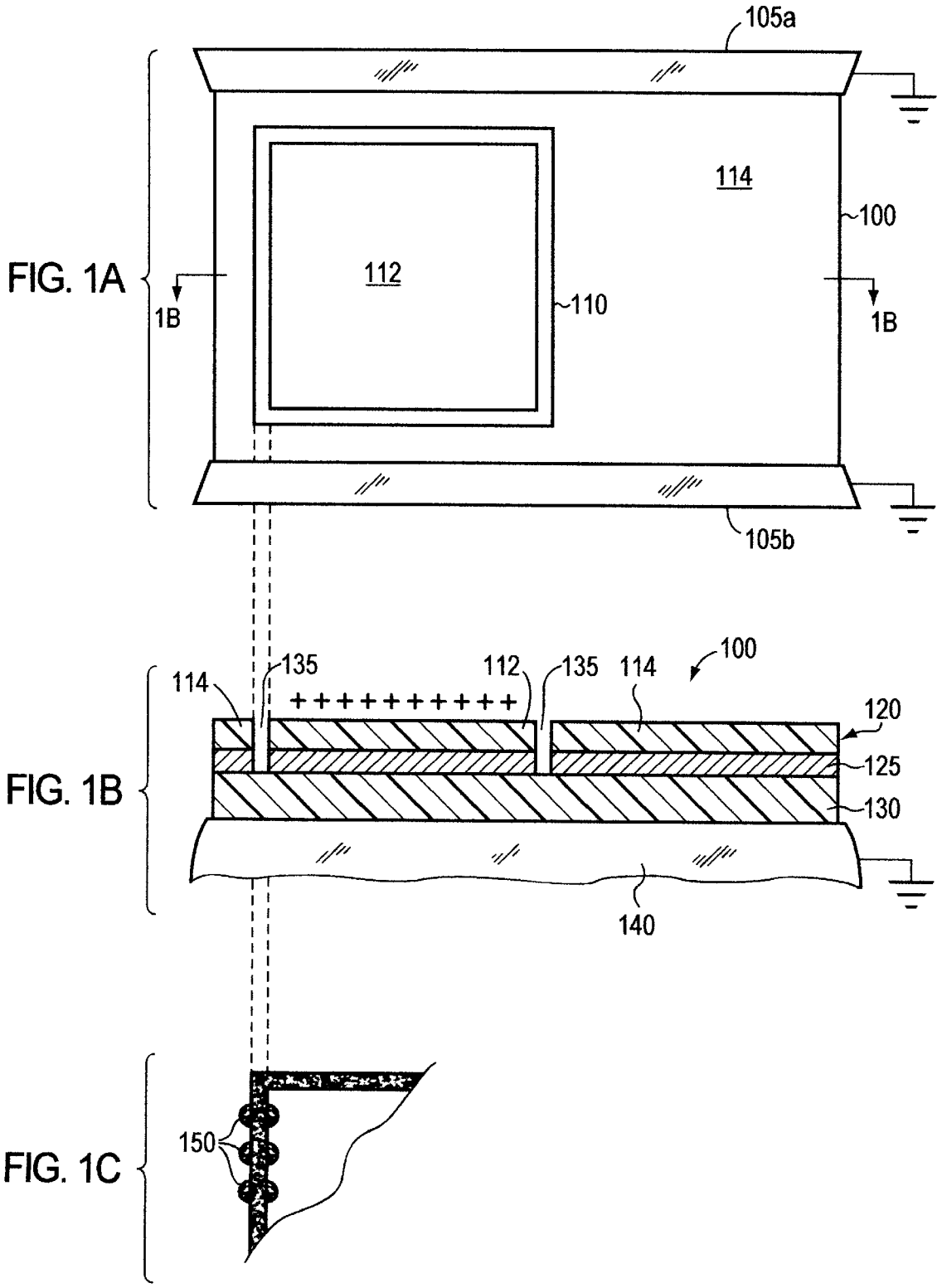
FIG. 1A is a plan schematic illustration of a printing plate having a floating region vulnerable to charge buildup.
FIG. 1B is an elevational section taken along the line 1B—1B, showing how charge can build up in the floating region.
FIG. 1C illustrates the type of printing defect that can result.

Refer first to FIG. 1, which illustrates a printing plate 100 pinned, by means of a pair of end clamps 105*a*, 105*b*, to the plate cylinder of a printing press or a platesetter. End clamps 105 are grounded through mechanical connection to the machine frame. Printing plate 100 is imaged by ablation using imaging apparatus as described, for example, in the '737 and '512 patents mentioned above and also U.S. Pat. No. 5,822,345 (the entire disclosure of which is hereby incorporated by reference). Suitable imaging apparatus includes at least one laser device that emits in the region of maximum plate responsiveness, i.e., whose $\text{lambda}_{max}$ closely approximates the wavelength region where the plate absorbs most strongly.

Suitable imaging configurations are also set forth in detail in the '737, '512, and '345 patents. Briefly, laser output can be provided directly to the plate surface via lenses or other beam-guiding components, or transmitted to the surface of a blank printing plate from a remotely sited laser using a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The plate 100 has been imaged so as to produce a thin, frame-like image area 110. This area encloses an unimaged region 112, and is surrounded by a larger unimaged region 114 in electrical contact with both clamps 105*a*, 105*b*. As a result, when the plate 100 is used to print, ink is received only by image area 110, and the printed copy is a replica of this area.

FIG. 1B shows a cross-section of plate 100 through the imaged region 110. The plate itself is a three-layer construction having a topmost layer 120 chosen for its lithographic affinity; an ablation layer 125, which is selectively destroyed by imaging radiation; and a substrate 130 whose lithographic affinity is opposite to that of the layer 120. In a representative example that will be followed for purposes of explanation, topmost layer 120 is silicone; ablation layer 125 is titanium; and substrate 130 is polyester, all in accordance with the '512 patent. The result is a dry plate whose silicone surface 120 repels ink. It should be recognized, however, that the principles of the invention are equally applicable to wet plates (with, for example, polyvinyl alcohol top layers) and plates having polymeric (e.g., nitrocellulose-based) ablation layers.

Where the plate 100 has been imaged to reveal layer 130, the plate accepts ink; the imaged regions appear as slot-like gaps 135. Removal of layer 120 above areas of layer 125 that have been destroyed may entail a post-imaging cleaning process (e.g., rubbing with or without a cleaning liquid as described, for example, in the '737 and '512 patents and in U.S. Pat. No. 5,378,580). Substrate 130 is in contact with a drum or plate cylinder 140, which, like clamps 105, is at ground potential.

Imaging and/or cleaning of plate 100 results in triboelectric charging—which may be negative or, as illustrated, positive—of region 112, which is electrically isolated from the remainder 114 of layer 120 (and, hence, grounded clamps 105). Electrostatic charge buildup can also occur during printing, i.e., as ink is transferred to and from plate 110 on a press. Electrostatic charge does not accumulate on region 114 because of the contact with clamps 105.

If layers 120, 130 are nonconductive, dielectric materials, region 112 behaves as a capacitor. The larger the area of region 112, the more charge it can accumulate, and the greater will be the potential difference between region 112 and ground. If this voltage is large enough and image area 110 thin enough (or, with reference to FIG. 1B, if gaps 135 are narrow enough), the charge can arc from region 112 to area 114 (i.e., across gaps 135). Arcing results in destruction of a small additional portion of layer 120 in the region of the arc, producing a widening or puckering the image region 110. The affected areas accept ink although they were not imaged by the laser, and manifest themselves as a series of visible defects 150 (see FIG. 1C) that mark where arcing occurred.

Obviously the depicted configuration represents a highly simplified plate image, but similar defects can occur even in more detailed image patterns. For example, the contents of area 114 are essentially irrelevant to the accumulation of static charge on area 112, and arcing can occur wherever the image area 110 narrows sufficiently. The factors that favor defects 150 are a large, electrically isolated area 112, a sufficiently thin image region 110, and adjacent regions having path to ground.

In accordance with the invention, the dielectric strength of the material intervening between the charged surface and ground potential is reduced, e.g., by means of a conductive or semiconductive substrate 130. The conductive substrate 130 reduces the net dielectric constant of the material intervening between charged region 112 and grounded support 140 (with which substrate 130 is in electrical contact), since the only significantly dielectric material is nonconductive layer 120. Consequently, the voltage resulting from a given deposited charge is diminished.

It has been found that the degree of conductivity necessary to avert defects as shown in FIG. 1C is, as a practical matter, generally fairly low. Arcing represents an extreme condition that is defeated by even modest decrease in the capacitance of the system (although obviously, the greater the conductivity of substrate 130, the more reliably will defects be avoided). At the same time, the thermally nonconductive nature of a polymeric substrate 130 is to be preserved, because this layer must prevent dissipation of laser energy into cylinder 140 (which represents a large heat sink). Successful ablation of layer 125 requires substantial buildup of heat within this layer, and any significant thermal conduction by substrate 130 will increase laser power requirements or prevent ablation altogether.

A useful working range of volume resistivities is from 0.5 to 10,000 Ω-cm. Accordingly, as used herein, the term "conductive" refers to a material having a volume resistivity of no more than 10,000 Ω-cm, and ideally less than 1000 Ω-cm. This is to be contrasted with a "non-conductive" polymeric layer generally having a volume resistivity in excess of $10^8$ Ω-cm. Suitable materials include conductive (e.g., pigment-loaded) polyesters or intrinsically conductive polymers such as polypyrrole or polyaniline, which can provide the necessary affinity for ink, thermal insulation, and support properties.

In an alternative approach, a conductive film is interposed between ablation layer 125 and substrate 130. When the plate 100 is engaged by clamps 105*a*, 105*b*, one or more edges of this layer makes at least some contact therewith. As a result, the plate structure is grounded above substrate 130 (which in this case is non-conductive), so that only layer 120 can act as a dielectric with respect to the surface charge.

It is also possible to reduce charge buildup by imparting conductivity to layer 120 and/or layer 125. For example, as described in the '737 patent, an ablation layer may be based on nitrocellulose with a dispersion of conductive carbon black pigment. Such a layer may actually be more conductive than the titanium ablation layer described above, since metal layers are typically applied at extremely small (e.g., 50–500 Å) thicknesses.

It will therefore be seen that I have developed effective measures to counteract the appearance of print defects of electrostatic origin in digitally imaged lithographic printing plates. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member including a polymeric top layer, an imaging layer, and a polymeric substrate, the imaging layer, but not the top layer, being formed of a material subject to ablative absorption of imaging radiation, the first layer and the substrate having different affinities for ink or a liquid to which ink will not adhere, the substrate, the imaging layer, and the top layer being conductive;

b. mounting the plate onto a grounded metal support so as establish electrical contact between the support and the substrate;

c. scanning at least one laser source over the printing member and selectively exposing, in a pattern representing an image, the printing member to output from the laser source during the course of the scan so as to ablate the imaging layer, thereby removing or facilitating removal of the top layer so as to directly produce on the member an array of image features;

wherein d. the array of image features includes at least one boundary region isolating an unimaged region; and e. electrostatic charge is applied to the top layer, the charge bleeding through the printing-member layers to ground, thereby preventing charge from arcing across the boundary region.

2. The method of claim 1 further comprising the step of removing the top layer where the imaging layer has been ablated, at least some of the electrostatic charge accumulating during the removing step.

3. The method of claim 1 further comprising the step of printing with the printing member, at least some of the electrostatic charge accumulating during the printing step.

4. The method of claim 1 wherein the imaging layer is metal.

5. The method of claim 1 wherein the imaging layer comprises a polymer.

6. The method of claim 1 wherein the top layer is oleophobic and the substrate is oleophilic.

7. The method of claim 6 wherein the top layer is silicone.

8. The method of claim 1 wherein the top layer is hydrophilic and the substrate is oleophilic and hydrophobic.

* * * * *